US008286842B2

(12) United States Patent
Carey

(10) Patent No.: US 8,286,842 B2
(45) Date of Patent: Oct. 16, 2012

(54) EXPANDABLE TRAVEL HANGER

(76) Inventor: Cheryl Carey, Wakinsville, GA (US)

( * ) Notice: Subject to any disclaimer, the term of this patent is extended or adjusted under 35 U.S.C. 154(b) by 0 days.

(21) Appl. No.: 12/784,451

(22) Filed: May 20, 2010

(65) Prior Publication Data

US 2010/0294815 A1 Nov. 25, 2010

Related U.S. Application Data

(60) Provisional application No. 61/179,763, filed on May 20, 2009.

(51) Int. Cl.
*A41D 27/22* (2006.01)

(52) U.S. Cl. ..... 223/89; 223/94

(58) Field of Classification Search ..... 223/85, 223/89, 90, 94, DIG. 4
See application file for complete search history.

(56) References Cited

U.S. PATENT DOCUMENTS

| | | | | |
|---|---|---|---|---|
| 1,114,294 | A * | 10/1914 | Routstone | 223/89 |
| 2,354,099 | A * | 7/1944 | Bess | 223/86 |
| 2,446,312 | A * | 8/1948 | Usina | 223/89 |
| 2,488,219 | A * | 11/1949 | Miller | 223/89 |
| 2,500,817 | A * | 3/1950 | Glassmeyer La Trelle B | 223/89 |
| 2,637,471 | A * | 5/1953 | Goldschmidt et al. | 223/89 |
| 3,645,426 | A | 2/1972 | Glascock | |
| 4,004,721 | A * | 1/1977 | Ross | 223/89 |
| 5,052,599 | A | 10/1991 | Platti | |
| 5,344,054 | A | 9/1994 | Nutter | |
| 5,598,957 | A | 2/1997 | Bell | |
| 5,893,493 | A | 4/1999 | Noiray | |
| 6,076,716 | A | 6/2000 | Reyes | |
| 6,179,174 | B1 | 1/2001 | Kandl | |
| 6,637,630 | B1 | 10/2003 | Rivenburgh | |
| 6,722,538 | B1 * | 4/2004 | Autry et al. | 223/94 |
| 7,036,696 | B2 | 5/2006 | Lam | |
| 7,249,699 | B2 | 7/2007 | Hill et al. | |
| 7,641,084 | B1 | 1/2010 | Alcaraz | |
| 2005/0092787 | A1 | 5/2005 | Stokes | |
| 2005/0199656 | A1 | 9/2005 | Harvey et al. | |
| 2006/0097018 | A1 | 5/2006 | Cresap et al. | |
| 2006/0208010 | A1 | 9/2006 | Lewien et al. | |
| 2007/0151997 | A1 | 7/2007 | Chen | |
| 2007/0246491 | A1 | 10/2007 | Shimura | |
| 2008/0283558 | A1 | 11/2008 | Rude | |
| 2009/0127298 | A1 | 5/2009 | Sprovieri | |
| 2009/0283556 | A1 | 11/2009 | Ho | |
| 2010/0038388 | A1 * | 2/2010 | Munro | 223/85 |
| 2010/0059557 | A1 | 3/2010 | Temali et al. | |

FOREIGN PATENT DOCUMENTS

GB 2277680 A * 11/1994

* cited by examiner

*Primary Examiner* — Nathan Durham
(74) *Attorney, Agent, or Firm* — Thien Tran, Esq; Access Patent Group, LLC

(57) ABSTRACT

An expandable travel hanger includes an adjustable triangular shaped frame, which can go from a compacted state for storage in a suitcase to an extended state to hang clothes therefrom. A hooked movable suspension component is located at an apex of the adjustable triangular frame, which can go from a compacted state for storage in the suitcase to an extended state for use to engage with a pole in a clothes closet. A pair of release buttons, wherein each the release button is located on each said curved tubular end support, so that when the release buttons are manually pressed, said adjustable triangular shaped frame will automatically go from the compacted state to the extended state.

7 Claims, 3 Drawing Sheets

EXPANDABLE TRAVEL HANGER

CROSS-REFERENCE TO RELATED APPLICATION

This application claims the benefit of Provisional Patent Application No. 61/179,763, filed on May 20, 2009, in the United States Patent & Trademark Office, the disclosure of which is incorporated herein by reference.

BACKGROUND OF THE INVENTION

1. Field of the Invention

The present invention relates to a coat hanger, and more particularly, an expandable travel hanger.

The expandable travel hanger is used when traveling in place of a traditional, cumbersome hanger that may be difficult to pack. The present invention allows individuals to hang up their clothes upon reaching their destination without taking up a large amount of a space in a suitcase or adding unnecessary weight to the suitcase. The expandable travel hanger is ideal for use by any traveler that may wish to pack their own hangers while commuting so they can efficiently hang up their clothes upon arrival.

2. Description of the Prior Art

Many travelers pack garments, which need to be hung up upon arrival to keep unattractive creases and wrinkles from forming. Some travelers pack traditional hangers in their suitcases, but these bulky items can take up valuable space and may also add weight to the suitcases. Many airlines are placing weight restrictions on luggage and travelers are looking for any way possible to reduce the size of their suitcases. Having a simple way to decrease the size and weight of a hanger so it can easily be stowed away for travel will assist many individuals in having a more pleasant traveling experience while knowing their clothes can easily be hung up upon arriving at their destination.

Numerous innovations for collapsible hangers have been provided in the prior art that will be described. Even though these innovations may be suitable for the specific individual purposes to which they address, however, they differ from the present invention.

A FIRST EXAMPLE, U.S. Patent Office Document No. 3,645,426, issued on Feb. 29, 1972, to Glascock et al. teaches a collapsible garment hanger which opens to a triangular shape and collapses to a shortened and elongated shape. A telescopic lower member which locks in an extended position is joined through pivotal links to the opposite ends of an extendable top member which defines the two upper inclined shoulder sections of the hanger. These upper sections pivotally attaches the hanger hook to the center of the top member.

A SECOND EXAMPLE, U.S. Patent Office Document No. 5,052,599, issued on Oct. 1, 1991, to Platti teaches an adjustable clothes hanger that includes two divergent shoulder portions connected to a crossbar at their ends thereof to be assembled with a pair of generally elongated tubular-shaped movable parts with an open channel at a bottom wherein the open channels of the movable parts are closed at the inner ends thereof to provide a stopping device as well as strength and stability. The movable parts slide manually. The slidable fittings are loose enough to slide easily, yet tight enough to secure desired position. The shoulder width of the hanger is thereby changed by the expansion or contraction of the movable parts. The hanger thus accommodates a variety of garment sizes. The adjustable principle can also be applied to a singular set of divergent shoulder portions with tubular-shaped movable parts. The adjustable principle can also be applied to two or three cross bar hangers, wherein U-shaped extensions provide for expansion and contraction of the hanger width. Widened shoulder sections on the movable parts are used to support a garment better. Adjustable hooks are generally telescopic and thereby vary the height of the hanger. The adjustable clothes hanger is simple and practical designed to adjust so as to hold garments properly and securely.

A THIRD EXAMPLE, U.S. Patent Office Document No. 5,344,054, issued on Sep. 6, 1994, to Nutter teaches a garment hanger of a type having opposing longitudinally slotted stationary arms, a hook, dowel holders, and a stationary dowel for hanging lower body clothing. Opposing adjustable arms fit into and slide in the longitudinal slots in the stationary arms and are attached by means of tension devices. The tension devices allow the opposing adjustable arms to remain in position once adjusted.

A FOURTH EXAMPLE, U.S. Patent Office Document No. 5,598,957, issued on Feb. 4, 1997, to Bell teaches an adjustable hanger which has a hanger body, opposed carrying arms that are slidably extendable from the hanger body to increase or decrease the size of the hanger, and a connecting rod that is rotatable to cause the carrying arms to be extended or retracted from the hanger body. The connecting rod can be a hollow tube wherein the ends of the opposed carrying arms are inserted into the connecting rod and wherein oppositely wound spiral grooves on the inside of the connecting rod mate with projections on the ends of the carrying arms so that rotation of the connecting rod causes the carrying arms to be extended or retracted from the connecting rod. Alternately, oppositely wound spiral grooves formed on the outside of the carrying arms may mate with projections on the inside of the connecting rod so that rotation of the connecting rod causes the carrying arms to be extended or retracted from the connecting rod.

A FIFTH EXAMPLE, U.S. Patent Office Document No. 5,893,493, issued on Apr. 13, 1999, to Noiray teaches a foldable and collapsible hanger which includes a pair of articulated upper branches pivotally coupled to, and extending from, opposite sides of a central hub which carries a hook. An articulated lower branch is pivotally coupled to, and extends between, distal ends of the upper branches to form a conventional hanger when deployed. The hanger may be folded along joints present in the upper and lower branches into a compact configuration that facilitates easy storage of the hanger.

A SIXTH EXAMPLE, U.S. Patent Office Document No. 6,076,716, issued on Jun. 20, 2000, to Reyes teaches a foldable garment hanger capable of being selectively positioned between a folded position, to facilitate storage and carrying, and an expanded position to facilitate removable support of a garment thereon. Two body portions are pivotally attached to one another so as to be selectively positioned between the folded and expanded positions wherein each body portion includes an arm member having an arm extension for varying the length of the arm thereby making the hanger assembly adaptable for garments of various sizes and increasing a collapsibility thereof. A support assembly is secured to the body of the hanger assembly and is structured to support the hanger with a garment thereon in a depending, suspended position from a supporting structure such as within an automobile or like vehicle or other more conventional location. A handle assembly is selectively positionable relative to a remainder of the hanger body between a stored position and an operative position and is structured to effectively lock the hanger body in its expanded position when the handle assembly is in its operative position. Alternately, the handle assembly is cooperatively structured with a remainder of the garment body so as to facilitate disposition of the hanger body from its expanded position into the folded position when the handle assembly is in its stored position.

A SEVENTH EXAMPLE, U.S. Patent Office Document No. 6,179,174, issued on Jan. 30, 2001, to Kandl teaches an adjustable hanger having a V-shaped hanging member and two V-shaped connectors, the V-shaped hanging member having a hook portion attached to two shaft members. Optionally, the hook portion may be pivotally attached to the two shaft members via a swivel. The V-shaped connectors are slidably engageable with the V-shaped hanging member and each other providing the user with an easy to use hanger that can be adjusted from eighteen inches to twenty-eight inches accommodating numerous different sizes of clothes.

AN EIGHTH EXAMPLE, U.S. Patent Office Document No. 6,637,630, issued on Oct. 28, 2003, to Rivenburgh teaches an adjustable clothing hanger which includes extension arms extending from the shoulders of a clothing hanger. The extension arms engage locks that secure the extension arms in a desired position. In one embodiment, the extension arms include receivers that mount to the ends of the shoulders. The extension arms are locked by an adjuster strip connected that engages the hook of the clothing hanger. In an alternate embodiment, the extension arms are supported and guided by a mount that is attached to the clothing hanger. An optional embodiment includes ridges engaging a detent to lock the extension arms in place.

A NINTH EXAMPLE, U.S. Patent Office Publication No. 2005/0092787, published on May 5, 2005, to Stokes teaches an extendable clothes hanger comprising a hook portion, opposed rigid side arms and opposed extension sleeves that are slidably mounted to the side arms and are movable between selected an extended mode and several selected extended modes. The extension sleeves can be selectively locked either at the unextended or extended modes wherein the extension sleeves are locked by pins relative to the side arms and can be unlocked so that the first and second sleeves are movable relative to the side arms. One embodiment includes solid rectangular arms and hollow rectangular sleeves and another embodiment includes a cylindrical arms enclosed by cylindrical sleeves. Bracing pins can be optionally included to activate when the sleeves are in their fully extended modes.

A TENTH EXAMPLE, U.S. Patent Office Publication No. 2005/0199656, published on Sep. 15, 2005, to Harvey et al. teaches a collapsible garment hanger including a hook element attached to a fixed arm, a sliding arm with a longitudinally oriented slot, a crosspiece extending through the slot, attaching the sliding arm slidably to the fixed arm. When the distal end of the fixed arm tilts upward, gravity will cause the sliding arm to slide away from the distal end of the fixed arm. Whenever the distal end of the fixed arm tilts downward, gravity will cause the sliding arm to slide towards the distal end of the fixed arm. The collapsible garment hanger can also manually slide away from or towards the distal end of the fixed arm. An offset spacing between the outer tip of the sliding arm when it is in the collapsed position and the opposing offset portion of the hanger determines the size of neck of garment through which the hanger will fit.

AN ELEVENTH EXAMPLE, U.S. Patent Office Document No. 7,036,696, issued on May 2, 2006, to Lam teaches a foldable and self-opening hanger which has two arms that fold down to a closed position away from the hanger's hook member with adjacent bottom arm edges proximal to each other. The arms are closed manually in opposition to a restoring force provided by an internal resilient member that tends to move the arms away from each other toward an open position suitable for hanging light garments such as shirts and blouses that exert opposing forces on the arms less than restoring force provided by the internal resilient member. For heavier garments, a lock-release mechanism is provided that holds the arms in a fully open-locked position that supports coats, heavy sweaters and the like. A pair of release buttons on opposite sides of the hanger release the lock-release mechanism allowing arms to be folded manually to the fully closed position so the hanger may be inserted into the neck of a garment without opening buttons or zippers. The arms then can be released from the closed position by merely letting go of them and allowing the resilient member to spread the arms open to support the garment to be hung.

A TWELFTH EXAMPLE, U.S. Patent Office Publication No. 2006/0097018, published on May 11, 2006, to Cresap et al. teaches an apparel apparatus that is especially useful for hanging narrow or small necked shirts and sweaters. It is a collapsible garment hanger, or clothing hanger, that has moving parts. There are two hanger arms that rotate about pins on a hanger body, and there is a fulcrum about which a quick-release lever and release tabs pivot so that a locking mechanism can be manipulated. All of the parts used with the apparatus are inexpensive plastic parts that can be injection molded, and the apparatus can be quickly assembled by snapping parts together A THIRTEENTH EXAMPLE, U.S. Patent Office Publication No. 2006/0208010, published on Sep. 21, 2006, to Lewien et al. teaches a collapsible garment hanger which includes a central support member comprising a supporting hook, a pair of elongate upper members pivotally connected to and extending in opposite directions from the central support member and a lower member pivotally connected between the far ends of the upper members, the lower member comprising a pair of elongate pivotally connected segments which when pivoted at their connecting point displace toward the central support member to provide a stable platform for supporting a garment hanging therefrom and away from the central support member to collapse and release a garment hanging therefrom.

A FOURTEENTH EXAMPLE, U.S. Patent Office Publication No. 2007/0151997, published on Jul. 5, 2007, to Chen teaches a type of "structure of flexible garment hanger" mainly comprising of a body and a hanging hook, enabling rapid dismantling. The body is composed of a cord and several tubes, with the respective tube containing a thread inside and sheaths at both ends. To assemble a flexible garment hanger, just slip the cord into the tubes of the body. Fix then two end of the cord respectively on the connecting plate. Buckle the hanging hook by a loop to the connecting plate. Finally, connect the central part with another tube by screwing its thread into another sheath. The flexible garment hanger is thus formed to hang the garment. The structure of this invention is simple to assemble, as well as being mobile and does not take up space.

A FIFTEENETH EXAMPLE, U.S. Patent Office Document No. 7,249,699, issued on Jul. 31, 2007, to Hill et al. teaches an apparel apparatus that is especially useful for hanging narrow or small necked shirts and sweaters. It is a collapsible garment hanger, or clothing hanger, that has moving parts. There are two hanger arms that rotate about pins on a hanger body, and there is a fulcrum about which a quick-release lever and release tabs pivot so that a locking mechanism can be manipulated. All of the parts used with the apparatus are inexpensive plastic parts that can be injection molded, and the apparatus can be quickly assembled by snapping parts together A SIXTEENTH EXAMPLE, U.S. Patent Office Publication No. 2007/0246491, published on Oct. 25, 2007, to Shimura teaches a hanger body with a body section, a pair of stick type extension members, which is embedded in the body section in such a manner that the respective ends of the stick type extension members extend from the body section in directions opposite to each other, a pair of shoulder sections which each have elastically deformable long bodies, and a storage section embedded in the body section in such a manner that each of the long bodies of the shoulder sections can be housed from each side of the long bodies. The hanger body has a plurality of locking means, which can be locked at the respective ends of the stick type extension members, on the other sides of the long bodies. In a state where the long bodies form the shoulder sections for clothing.

A SEVENTEENTH EXAMPLE, U.S. Patent Office Publication No. 2008/0283558, Published on Nov. 20, 2008, to Rude et al. teaches a garment hanger with a hook that pivots between a substantially vertical position and a substantially horizontal position. The body of the hanger has detents for securing the hook in either the vertical or horizontal position. The hook is capable of being alternately attached and detached from the body of the hanger. The hook additionally is capable of being rotated along a substantially vertical axis.

AN EIGHTEENTH EXAMPLE, U.S. Patent Office Publication No. 2009/0127298, published on May 21, 2009, to Sprovieri teaches a collapsible garment hanger comprising a central portion including a top portion with a hanger support for engaging a garment support, a bottom portion, and two outer parts containing a pivot, two garment supporting members, each having a first outer end and a second inner end, provided proximate the first outer end, a garment supporting arm, and having disposed proximate the second inner end a pivot engaging part, wherein the garment supporting members are connected to the pivot and are moveable in relation to the central portion, wherein the outer parts of the central portion contain the pivot, the bottom portion of the central portion being operably connected to the pivot and movably engaged with the garment supporting members, wherein the bottom portion of the central portion is adapted to move from a first position wherein the garment supporting members extend laterally away from the central portion, to a second position whereat the outer ends of the garment supporting members extend generally downwardly away from the central portion.

A NINETEENTH EXAMPLE, U.S. Patent Office Publication No. 2009/0283556, published on Nov. 19, 2009, to Ho teaches a collapsible hook hanger having a metal hook moveable between an upright position for displaying garments and a folded position for reducing the footprint of the hanger during packaging/transportation of pre-hung garments.

A TWENTYEETH EXAMPLE, U.S. Patent Office Document No. 7,641,084, issued on Jan. 5, 2010, to Alcaraz teaches an adjustable clothes hanger which includes a hollow body provided with a chamber formed therein, first and second arms conjoined to the body and disposed exterior of the chamber, and a mechanism for slidably and linearly displacing the first and second arms along respective linear paths in such a manner that the first and second arms simultaneously extend and retract along opposed flanges of the body. The device further includes first and second hooks partially seated within the chamber and disposed along the flanges. Each of such first and second hooks has top ends terminating outwardly from the chamber and traversing respective travel paths of the first and second arms when the primary and secondary dials are rotated in corresponding directions such that the first and second arms are engaged and stopped from traveling there beyond.

A TWENTYFIRST EXAMPLE, U.S. Patent Office Publication No. 2010/0059557, published on Mar. 11, 2010, to Temali et al. teaches a perfect shirt hanger that is a premium-quality, hook-topped collapsible shirt hanger, manufactured in injection-molded thermoplastic or wood having the collapsible shoulder and upper-arm portions contoured and shaped to provide a crease-free hang for the shirt or other garment, and is flared somewhat to further preserve the garment's natural shape.

It is apparent now that numerous innovations for collapsible hangers have been provided in the prior art that are adequate for various purposes. Furthermore, even though these innovations may be suitable for the specific individual purposes to which they address, accordingly, they would not be suitable for the purposes of the present invention as heretofore described.

SUMMARY OF THE INVENTION

AN OBJECT of the present invention is to provide an expandable travel hanger that avoids the disadvantages of the prior art.

ANOTHER OBJECT of the present invention is to provide an expandable travel hanger that is simple and inexpensive to manufacture.

STILL ANOTHER OBJECT of the present invention is to provide an expandable travel hanger that is simple to use.

BRIEFLY STATED, STILL YET ANOTHER OBJECT of the present invention is to provide an expandable travel hanger that comprises an adjustable triangular shaped frame, which can go from a compacted state for storage in a suitcase to an extended state to hang clothes therefrom. A hooked movable suspension component is located at an apex of the adjustable triangular frame, which can go from a compacted state for storage in the suitcase to an extended state for use to engage with a pole in a clothes closet.

The novel features which are considered characteristic of the present invention are set forth in the appended claims. The invention itself, however, both as to its construction and its method of operation, together with additional objects and advantages thereof, will be best understood from the following description of the specific embodiments when read and understood in connection with the accompanying drawing.

BRIEF DESCRIPTION OF THE DRAWING

The figures of the drawings are briefly described as follows.

REFERENCE NUMERALS UTILIZED IN THE DRAWING

110 expandable travel hanger

Figure 1:
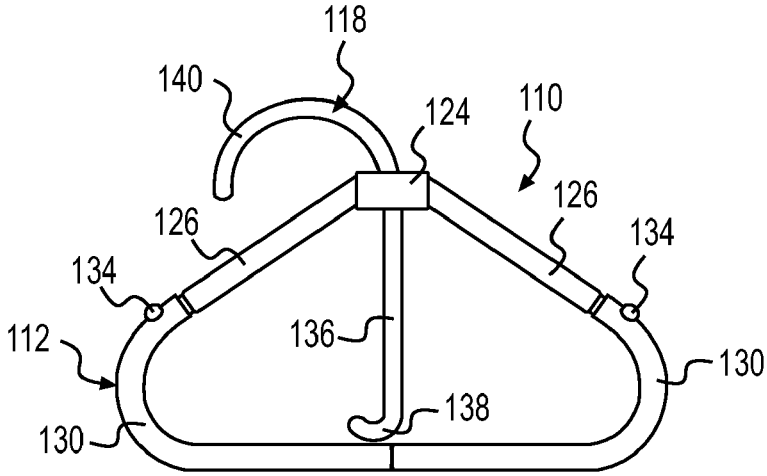
FIG. 1 is an elevational view of the present invention in a compacted state.

112 adjustable triangular shaped frame of hanger 110

114 suitcase
116 clothes
118 hooked movable suspension component of hanger 110
120 pole
122 clothes closet
124 junction bracket of frame 112
126 stationary tubular arm of frame 112
128 movable tubular arm of frame 112
130 curved tubular end support of frame 112
132 horizontal tubular rod of frame 112
134 release button of frame 112
136 shank of hooked movable suspension component 118
138 stop member of hooked movable suspension component 118
140 hook member of hooked movable suspension component 118

DETAILED DESCRIPTION OF THE PREFERRED EMBODIMENT

Figure 2:
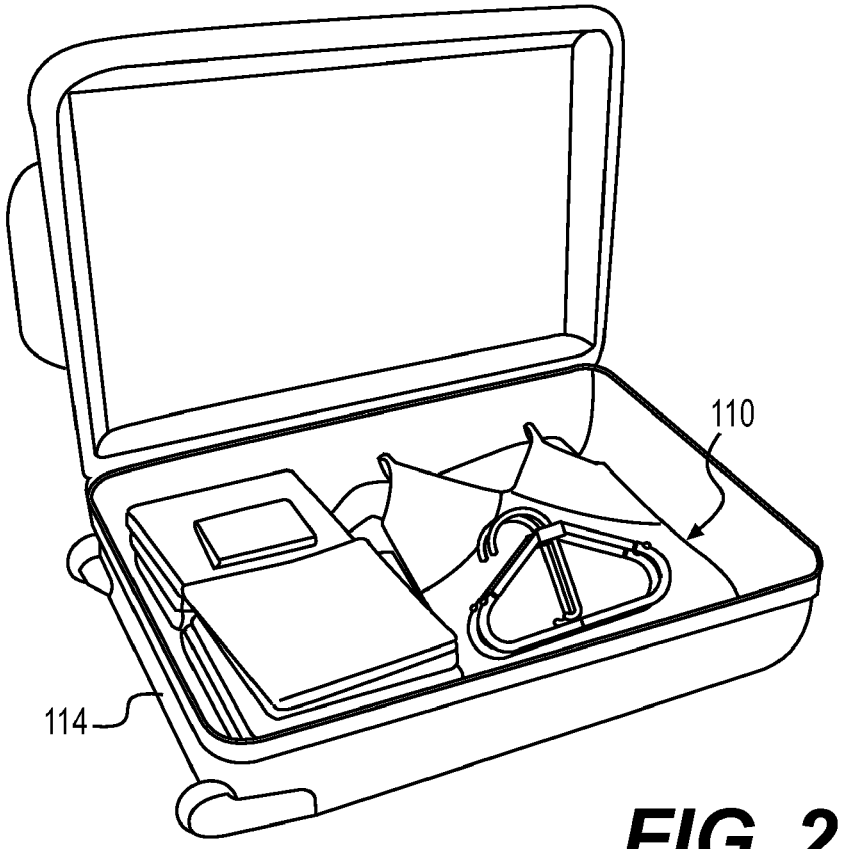
FIG. 2 is a perspective view showing the present invention in the compacted state in a suitcase.
Figure 3:
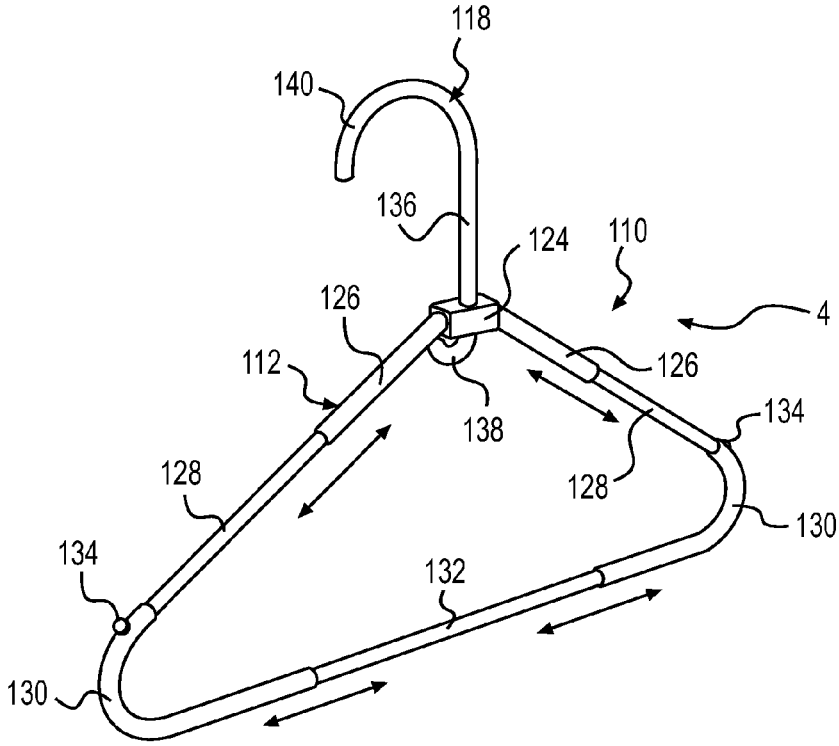
FIG. 3 is a perspective view showing the present invention in an extended state.
Figure 4:
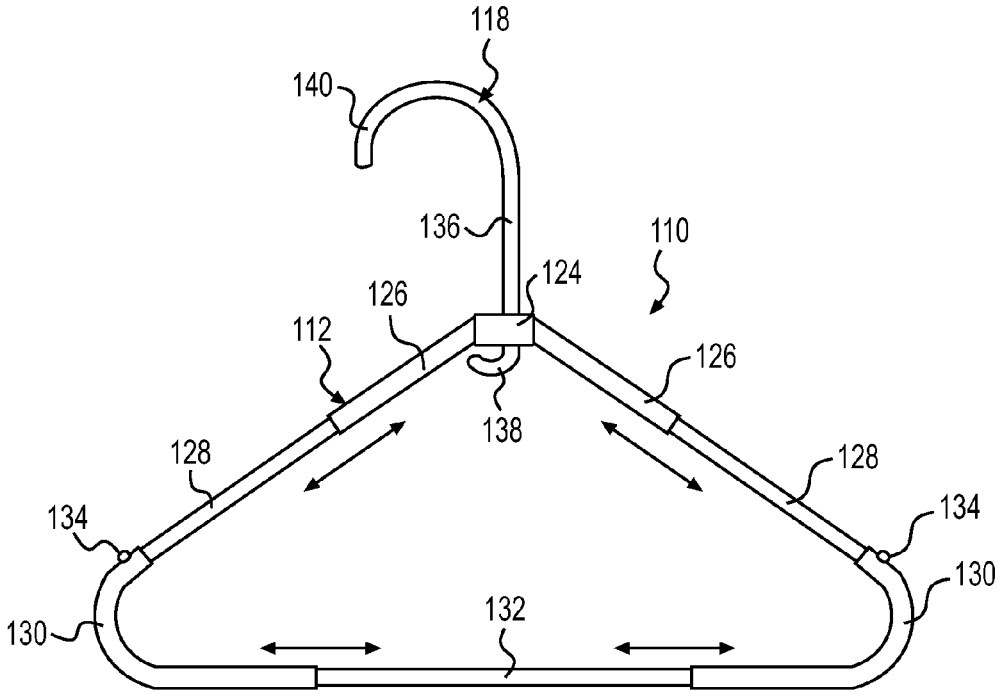
FIG. 4 is an elevational view taken in the direction of arrow 4 in FIG. 3.
Figure 5:
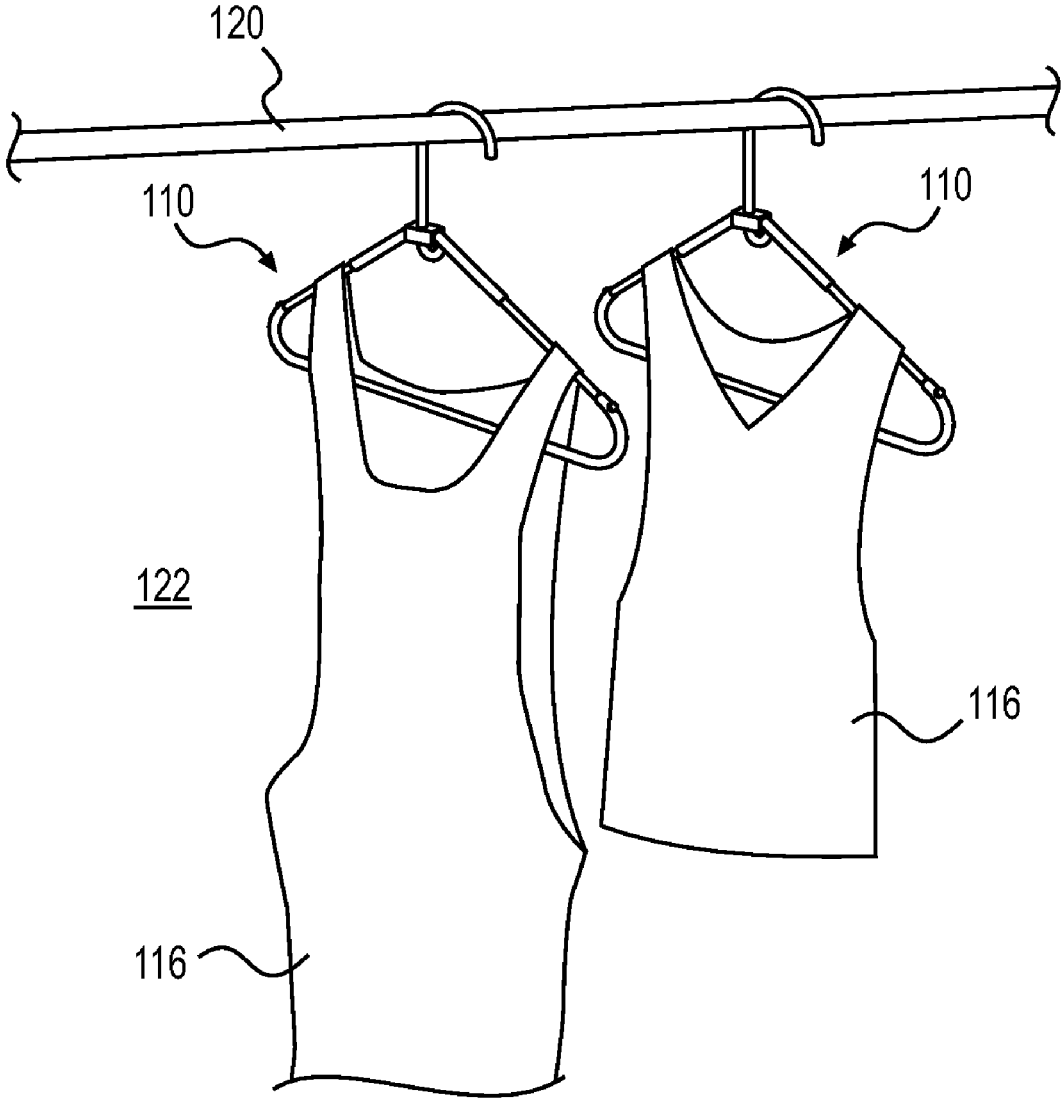
FIG. 5 is a perspective view showing the present invention in the extended state in use hanging clothes.

Referring now to the figures, in which like numerals indicate like parts, and particularly to FIGS. 1 through 5, and as such, will be discussed with reference thereto.

The present invention is an expandable travel hanger 110 which comprises an adjustable triangular shaped frame 112, which can go from a compacted state for storage in a suitcase 114 to an extended state to hang clothes 116 therefrom. A hooked movable suspension component 118 is located at an apex of the adjustable triangular frame 112, which can go from a compacted state for storage in the suitcase 114 to an extended state for use to engage with a pole 120 in a clothes closet 122.

The adjustable triangular shaped frame 112 comprises a junction bracket 124 located at the apex of the adjustable triangular shaped frame 112. A pair of stationary tubular arms 126 are provided. Each stationary tubular arm 126 extends in a downwardly inclined position from each opposite side of the junction bracket 124. A pair of movable tubular arms 128 are provided. Each movable tubular arm 128 extends in a telescopic manner from a free end of each stationary tubular arm 126. A pair of curved tubular end supports 130 are provided. Each curved tubular end support 130 retains a free end of each movable tubular arm 128. A horizontal tubular rod 132 slideably extends between the pair of curved tubular end supports 130. A pair of release buttons 134 are also provided. Each release button 134 is located on each curved tubular end support 130. When release buttons 134 are manually pressed the adjustable triangular shaped frame 112 will automatically go from the compacted state to the extended state, to allow the clothes 116 to hang therefrom.

The hooked movable suspension component 118 comprises a shank 136 which vertically passes through the junction bracket 124. A stop member 138 is formed on bottom end of the shank 136. A hook member 140 is formed on top end of the shank 136 to engage with the pole 120 in the clothes closet 122.

The hanger 110 when in its compacted state is of a size of approximately four inches high by nine inches long, while in its extended state will almost double its size to approximately eight inches high by fifteen inches long. The hanger 110 is fabricated out of a lightweight durable material, such as plastic, aluminum, or wood.

The expandable travel hanger 110 will extend to become a full-sized hanger when needed, but remains compacted during storage. The present invention operates by manually pressing the release buttons 134 on the curved tubular end supports 130, similar to an umbrella, which allows the hanger 110 to extend to almost double its original size, forming a standard-sized clothes hanger. The hanger 110 begins in a compacted state of approximately four inches high and nine inches long. By manually pressing each release button 134 on each curved tubular end support 130, the hanger 110 will extend to almost double its length to a finished size of approximately eight inches high by fifteen inches long. The hooked movable suspension component 118 of the hanger 110 can also be pushed down for storage. The hanger 110 is fabricated from a lightweight, yet durable plastic, aluminum, wood or other similar materials. The present invention may be available in packages of six or eight in assorted colors to accommodate user preferences. The exact dimensions, materials used for construction and method of operation of the expandable travel hanger 110 may vary upon manufacturing.

It will be understood that each of the elements described above, or two or more together, may also find a useful application in other types of constructions differing from the types described above.

While the invention has been illustrated and described as embodiments of a travel hanger, accordingly it is not limited to the details shown, since it will be understood that various omissions, modifications, substitutions and changes in the forms and details of the device illustrated and its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute characteristics of the generic or specific aspects of this invention.

The invention claimed is:

1. An expandable travel hanger which comprises:

a) an adjustable triangular shaped frame, which can go from a compacted state for storage in a suitcase to an extended state to hang clothes therefrom; wherein said adjustable triangular shaped frame comprises:

b) a junction bracket located at the apex of said adjustable triangular shaped frame:

c) a pair of stationary tubular arms, wherein each said stationary tubular arm extends in a downwardly inclined position from each opposite side of said junction bracket:

d) a pair of movable tubular arms, wherein each said movable tubular arm extends in a telescopic manner from a free end of each said stationary tubular arm;

e) a pair of curved tubular end supports, wherein each said curved tubular end support retains a free end of each said movable tubular arm;

f) a horizontal tubular rod slideably extends between said pair of curved tubular end supports; and g) a pair of release buttons, wherein each said release button is located on each said curved tubular end support, so that when said release buttons are manually pressed said adjustable triangular shaped frame will automatically go from the compacted state to the extended state, to allow the clothes to hang therefrom, and h) a movable suspension component located at an apex of said adjustable triangular frame, which can go from a compacted state for storage in the suitcase to an extended state for use to engage with a pole in a clothes closet.

2. The hanger as recited in claim 1, wherein said movable suspension component comprises:

a) a shank which vertically passes through said junction bracket;

b) a stop member formed on bottom end of said shank; and c) a hook member formed on top end of said shank to engage with the pole in the clothes closet.

3. The hanger as recited in claim 1, wherein said hanger when in its compacted state is of a size of approximately four inches high by nine inches long, while in its extended state will almost double its size to approximately eight inches high by fifteen inches long.

4. The hanger as recited in claim 1, wherein said hanger is fabricated out of a lightweight durable material.

5. The hanger as recited in claim 4, wherein said lightweight durable material is plastic.

6. The hanger as recited in claim 4, wherein said lightweight durable material is aluminum.

7. The hanger as recited in claim 4, wherein said lightweight durable material is wood.

* * * * *